US005321199A

United States Patent [19]

Kondo

[11] Patent Number: 5,321,199

[45] Date of Patent: Jun. 14, 1994

[54] METHOD AND DEVICE FOR PREVENTING IMBALANCE OF SOUND EMISSIONS IN AN AUTOMATIC PERFORMING PIANO

[75] Inventor: Tetsusai Kondo, Hamamatsu, Japan

[73] Assignee: Kabushiki Kaisha Kawai Gakki Seisakusho, Japan

[21] Appl. No.: 904,349

[22] Filed: Jun. 25, 1992

[30] Foreign Application Priority Data

Jun. 26, 1991 [JP] Japan ..... 3-154961

[51] Int. Cl.[5] ..... G10H 7/00; G10H 1/18

[52] U.S. Cl. ..... 84/615; 84/618; 84/609; 84/23

[58] Field of Search ..... 84/19-23, 84/615, 618, 626, 609

[56] References Cited

U.S. PATENT DOCUMENTS

| | | | |
|---|---|---|---|
| 4,132,141 | 1/1979 | Campbell et al. . | |
| 4,593,592 | 6/1986 | Stahnke | 84/21 |
| 4,970,928 | 11/1990 | Tamaki | 84/21 |
| 5,016,513 | 5/1991 | Stahnke | 84/19 |
| 5,022,301 | 6/1991 | Stahnke | 84/21 |
| 5,083,491 | 1/1992 | Fields | 84/21 |
| 5,164,532 | 11/1992 | Ishii et al. | 84/639 |

FOREIGN PATENT DOCUMENTS

| | | |
|---|---|---|
| 53-20315 | 2/1978 | Japan . |
| 53-102020 | 9/1978 | Japan . |
| 55-84088 | 6/1980 | Japan . |
| 58-18691 | 2/1983 | Japan . |
| 58-179894 | 10/1983 | Japan . |
| 61-128295 | 6/1986 | Japan . |
| 63-37395 | 2/1988 | Japan . |
| 63-217908 | 8/1988 | Japan . |
| 63-44867 | 11/1988 | Japan . |
| 63-301997 | 12/1988 | Japan . |
| 64-44936 | 2/1989 | Japan . |
| 64-247666 | 9/1989 | Japan . |
| 64-291944 | 11/1989 | Japan . |
| 1-332912 | 12/1989 | Japan . |
| 2164192 | 3/1986 | United Kingdom . |
| WO80/02886 | 12/1980 | World Int. Prop. O. . |

*Primary Examiner*—William M. Shoop, Jr.
*Assistant Examiner*—Jeffrey W. Donels
*Attorney, Agent, or Firm*—Davis, Bujold & Streck

[57] ABSTRACT

A device and method prevents the imbalance of emission timing between strong key strokes and weak key strokes in an automatic performing piano by preventing the occurrence of reverse phenomenon and overlap phenomenon by correcting cessation timing according the order or sequence of key strokes. A reverse phenomenon, where cessation timing for one key stroke precedes its counterpart emission timing, is prevented by changing cessation timing to occur after emission timing. An overlap phenomenon, where emission timing for the latter of two successive strokes precedes cessation timing for the former stroke, is prevented by changing the cessation timing to occur prior to the emission timing. The method and device thus achieves reproduction of performance with balanced and controlled sound emission timing and high fidelity in performance reproduction.

7 Claims, 18 Drawing Sheets

Fig.7

| TDrec | KNo. | Pon | UNOCCUPIED |
|---|---|---|---|
| 01h(5msec) | 20h | 75h | |
| 02h(10msec) | 22h | 2Fh | |
| 07h(35msec) | 34h | 0Fh | |
| 03h(15msec) | 36h | 22h | |
| | | | |

Fig.10A

| | TDplay | KNo. | Pon | UNOCCUPIED | |
|---|---|---|---|---|---|
| 32-key CESSATION | 07h(35msec) | 20h | 00h | | ALREADY ALLOCATED |
| | 03h(15msec) | 34h | 0Fh | | |
| 32-key EMISSION | 05h(25msec) | 20h | 2Fh | | NEWLY ALLOCATE |
| | | | | | |

Fig.10B

| | TDplay | KNo. | Pon | UNOCCUPIED | |
|---|---|---|---|---|---|
| 32-key CESSATION | 04h(20msec) | 20h | 00h | | ALREADY ALLOCATED |
| | 03h(15msec) | 34h | 0Fh | | |
| 32-key EMISSION | 05h(25msec) | 20h | 2Fh | | NEWLY ALLOCATE |
| | | | | | |

Fig.11A

| | TDplay | KNo. | Pon | UNOCCUPIED | |
|---|---|---|---|---|---|
| 32-key EMISSION | 0Eh(70msec) | 20h | 75h | | ALREADY ALLOCATED |
| | 05h(25msec) | 22h | 2Fh | | |
| | 03h(15msec) | 34h | 0Fh | | |
| 32-key CESSATION | 07h(35msec) | 20h | 00h | | NEWLY ALLOCATE |
| | | | | | |

Fig.11B

| | TDplay | KNo. | Pon | UNOCCUPIED | |
|---|---|---|---|---|---|
| 32-key EMISSION | 0Eh(70msec) | 20h | 75h | | ALREADY ALLOCATED |
| | 05h(25msec) | 22h | 2Fh | | |
| | 03h(15msec) | 34h | 0Fh | | |
| 32-key CESSATION | 014h(100msec) | 20h | 00h | | NEWLY ALLOCATE |

PRIOR ART

METHOD AND DEVICE FOR PREVENTING IMBALANCE OF SOUND EMISSIONS IN AN AUTOMATIC PERFORMING PIANO

BACKGROUND OF THE INVENTION

This invention relates to a method and device for controlling sound emission in an automatic performing piano, and more specifically to such a piano which is immune from inaccuracy of performance in sound reproduction due to the time lag of emission of sound caused by variations in intensity of depressed keys.

A conventional automatic performing piano has suffered from imbalance of sound emission timing between strong strokes and weak strokes. This is due to the time period from a depress-key command (on-event) to actual emission of sound during which a solenoid is energized.

Some prior art methods try to solve this problem by adopting a sound prohibited time period T1, FIG. 12, in designing the amount of electric power $L_{drv}$ to be supplied to the solenoid for depressed keys. In FIG. 12, $L_1$ is an original voltage level, $L_2$ a start-up voltage level, and $L_3$ is a holding voltage level. $T_2$ is a time period to sustain the start-up voltage level. The sound prohibited time period $T_1$, as shown in FIG. 12, is provided at the first stage of the chart of electric power $L_{drv}$ in order to correct the emission timing. The sound prohibited time period $T_1$ is determined according to depression intensity data included in depression data such that the stronger the stroke is, the longer the duration of sound prohibited time period $T_1$. The maximum value of the sound prohibited time period $T_1$ is 100 milliseconds.

However, determination of the sound prohibited time period T1 simply according to the depression intensity data results in the following two undesirable phenomena.

One is a "reverse phenomenon" which is often caused by one strong but short key stroke. Since the sound prohibited time period T1 drags on because of the intensity of the key stroke, the off-event command in response to the release of the same key may precede the start up of the driving power. In reproduction of hora staccato notes, with a sound emission time period of only 30 milliseconds for each of the key strokes, this "reverse phenomenon" may occur, thus resulting in failure to reproduce the performance.

The other undesirable phenomenon is an "overlap phenomenon". When a strong key stroke on one key is immediately followed by a weak key stroke on the same key, the off-event for the strong key stroke may be caused after the expiration of the sound prohibited time period T1 for the weak key stroke, thus hampering reproduction of successive key strokes on the same key.

SUMMARY OF THE INVENTION

Wherefore, an object of this invention is to provide a method and device for controlling sound emission in an automatic performing piano which realizes superior performance and high fidelity of sound reproduction. The method and device solves the imbalance of emission timing between strong key strokes and weak key strokes, and is also free from the resultant reverse phenomenon and overlap phenomenon of the prior art, thereby providing reproduction of performance with balance and high fidelity.

In order to achieve the above object, the method according to the present invention comprises the following steps. As shown in FIG. 1, depression data comprising key number and depression intensity, and release data comprising key number, are read out in turn along the performance, S1. A solenoid is then driven by electric power having a value determined according to the depression intensity included in the read depression data, and its activation terminated according to the release data, S5. The method also comprises the following steps which are characteristic to the present invention. The performance information is delayed according to the time lag between depress-key and emission of sound in reproduction, thereby matching the emission timing for strong key strokes and weak key strokes, S2. If the resultant order of emission timing and cessation timing is different from the order of depress-key timing and release-key timing within the stored performance information, the matched data are further corrected, S3 and S4.

In the method according to the present invention, the step S2 where the emission timing is matched prevents imbalance of emission timing between strong key strokes and weak key strokes during a reproduction mode. Further, the corrections in S3 and S4 prevents occurrence of "reverse phenomenon" and "overlap phenomenon".

A device according to the present invention comprises, as shown in FIG. 2, performance information memory means M1, performance information readout means M2, and solenoid drive means M3. The performance information memory means M1 stores performance information comprising depression data and release data, in proper order or sequence. The performance information readout means M2 reads out in proper order the stored performance information comprising depression data and release data. The solenoid drive means M3 drives a solenoid by electric power having a value determined according to the depression intensity included in the depression data.

The device according to the present invention also comprises matching means M4 and cessation timing change-over means M5, thereby preventing occurrence of "reverse phenomenon". The matching means M4 matches emission timing of strong key strokes and weak key strokes by delaying performance information read out by the readout means M2 according to the time lag between depression of a key and emission of sound in reproduction. The cessation timing change-over means M5 changes cessation timing to occur after its counterpart emission timing when the emission timing and the cessation timing for one stroke is reversed by the matching.

In order to prevent the "overlap phenomenon", the device according to the prevent invention may comprise the above means, but with the cessation timing change-over means M5 modified. Specifically, when an emission timing for the latter of two successive key strokes on the same key precedes a cessation timing for the former key stroke by the matching operation, the cessation timing change-over means M5 changes the cessation timing for the former stroke to prior to the emission timing for the latter stroke.

BRIEF DESCRIPTION OF THE DRAWINGS

FIG. 7 is an explanatory table to show the content of a temporary memory in the recording process steps;

FIGS. 10A and 10B are explanatory tables to show how an "overlap phenomenon" is prevented in reproduction process steps of successive strokes on one same key;

FIGS. 11A and 11B are explanatory tables to show how a "reverse phenomenon" is prevented in the reproduction process steps;

DETAILED DESCRIPTION OF THE PREFERRED EMBODIMENT

An embodiment of an automatic performing piano adopting a method and device for controlling sound emission according to the present invention will now be explained.

Figure 1:
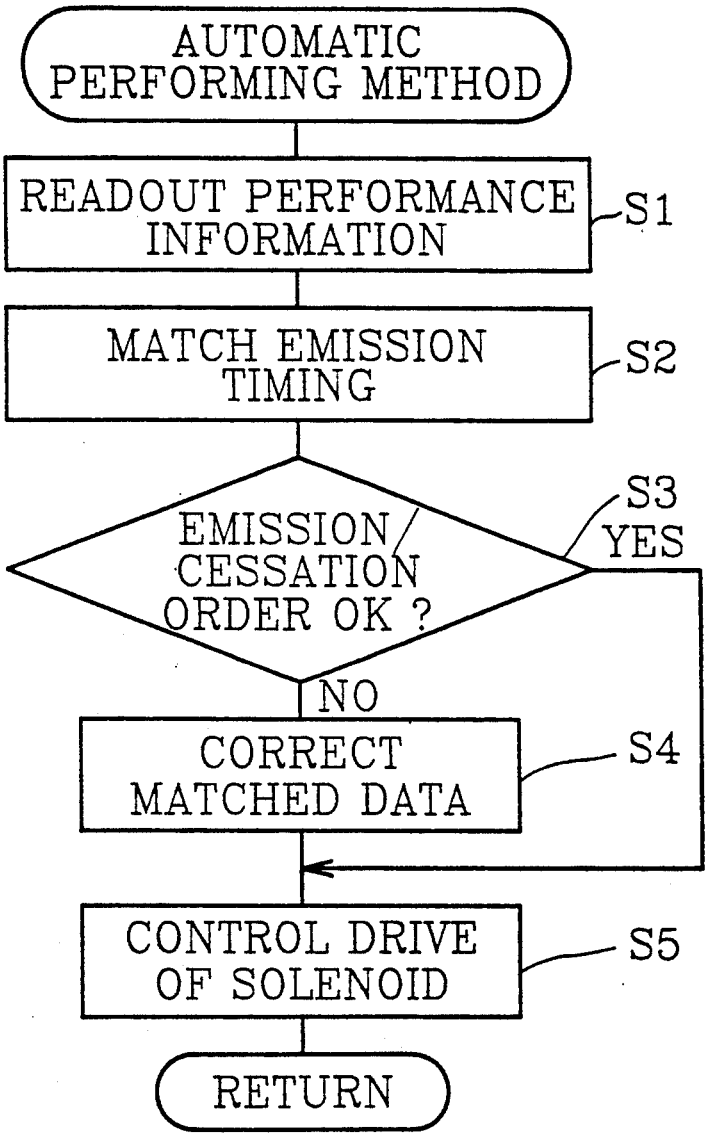
FIG. 1 is a schematic flowchart to show steps of a method for controlling sound emission in an automatic performing piano according to the present invention.
Figure 2:
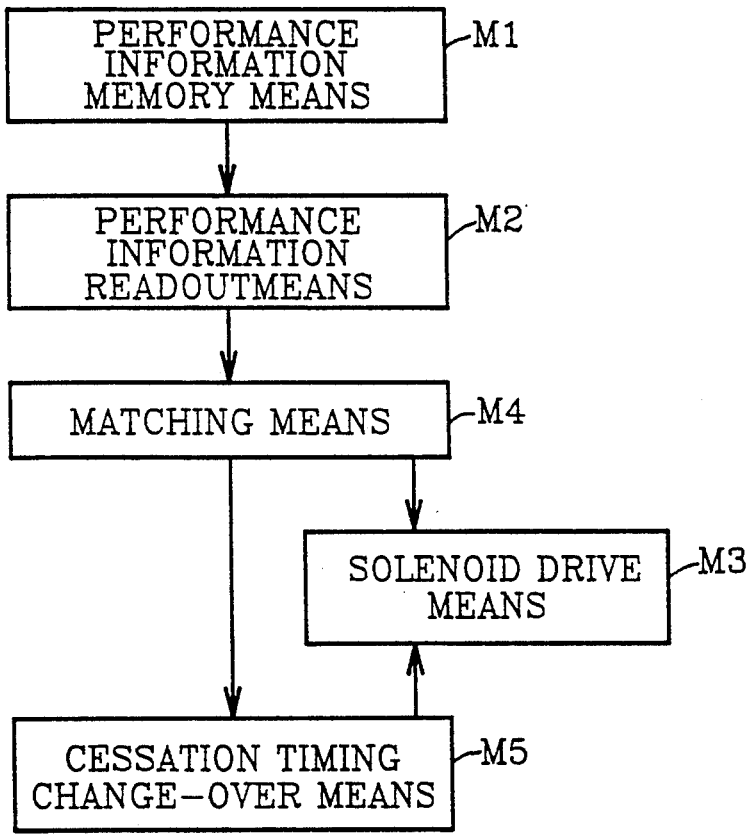
FIG. 2 is schematic diagram which illustrates the structure of a device for controlling sound emission in an automatic performing piano according to the present invention.
Figure 3:
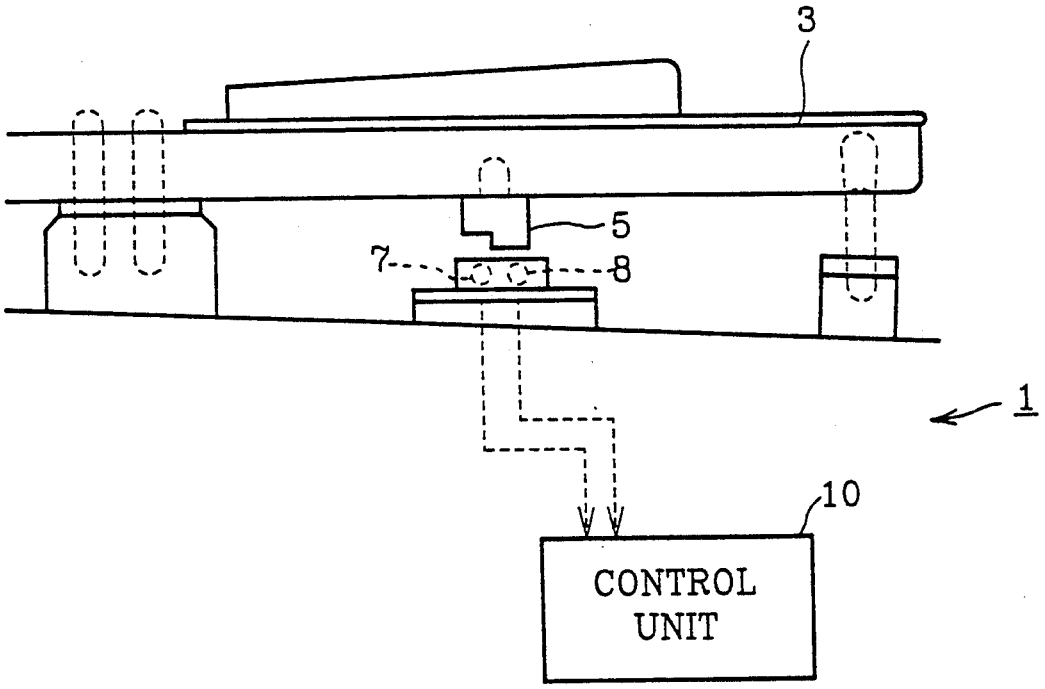
FIG. 3 is schematic illustration showing the structure of key sensors and other members for calculating key depression intensity of an automatic performing piano embodying the present invention.

As shown in FIG. 3, an automatic performing piano 1 of this embodiment is provided with keys 3. Each of the keys 3 comprises a stepped shutter 5, key sensors 7 and 8, and a control unit 10. Each of the key sensors 7 and 8 comprises one each of a light emitting element and a light receiving element. The control unit 10 detects the time and the time lag when the stepped shutters 5 are intermediate or between each of the key sensors 7 and the key sensors 8 to block the light path. The control unit 10 then formulates performance information including key number, timing of depression, timing of release of key and intensity of key strokes.

Figure 4:
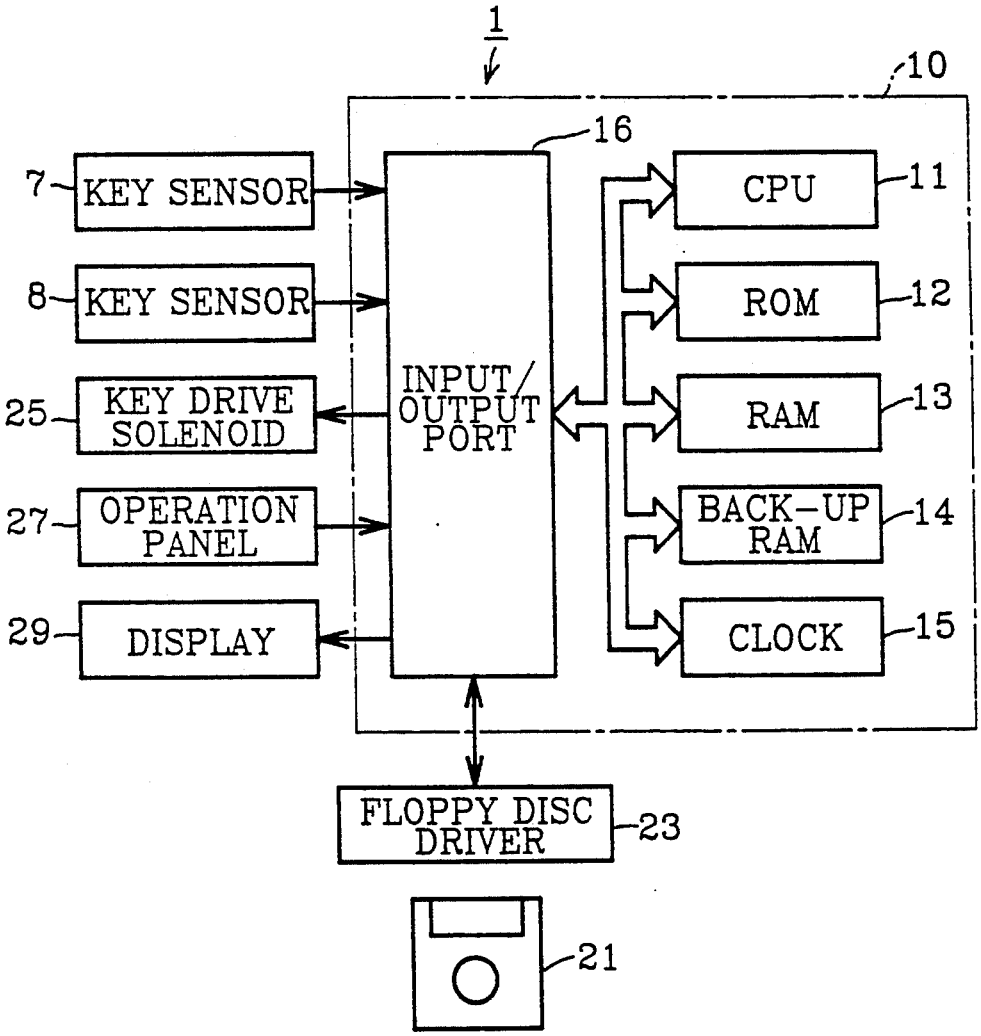
FIG. 4 is a schematic diagram which shows the relationship between a control unit and composing members of one embodiment of the present automatic performing piano with controlled sound emission.

Each of the control units 10, FIG. 4, includes CPU 11, ROM 12, RAM 13, back-up RAM 14, and a clock 15. This circuit is connected to the key sensors 7 and 8 via an input/output port 16. The control units 10 are also connected to floppy disc drives 23, key drive solenoids 25, an operation panel 27, and a display 29 via the input/output port 16. The floppy disc drivers 23 control floppy discs 21 storing performance information. The key drive solenoids 25 drive keys 3 during automatic performance. The operation panel 27 is provided for selecting an operation mode such as recording, reproduction (playback) or other similar modes.

The above hardware structure is generally in common with the prior art devices. The present automatic performing piano according to one embodiment is characteristic in recording a performance as shown in the steps specified in FIGS. 5A and 5B.

The recording method adopted in this embodiment of the present invention is as follows:

This process starts when the recording mode is selected, S100, on the operation panel 27. In the embodiment, recording and reproduction modes are conducted according to the so called "event method".

It is first examined whether the signals from the key sensors 7 and 8 have changed in response to depression or release of a key, S101. If the signals have changed, the timing $t_{on}$ at which an on-event occurred or the timing $t_{off}$ at which an off-event occurred is determined by the detected value of the key sensors 7 and 8, S102. Specifically, the timing $t_{on}$ is determined by the timing when the value of the key sensor 7 changes from "on" to "off", and the timing $t_{off}$ is determined by the timing when the value of the key sensor 8 changes from "off" to "on".

Subsequently, it is examined whether the change of signals is due to depression of a key, S102*a*. If $t_{on}$ is determined at S102, depression of a key is detected. Then a time lag $\Delta t$ between the time when the value of the key sensor 8 changed from "on" to "off" and the time when the value of the key sensor 7 changed from "on" to "off" is calculated, S103.

Next, depression intensity data $P_{on}$ is calculated according to the time lag $\Delta t$, S104. In the figure, K is a coefficient for logical operation, and is predetermined according to the location and the size of the step of the shutters 5 and other factors. A time delay period of emission in recording $TD_{rec\text{-}on}$ is then calculated according to the depression intensity data $P_{on}$, S105. The emission delay in recording $TD_{rec\text{-}on}$ is due to the traveling speed of the keys 3 which causes a time lag between occurrence of on-event and actual emission of sound as a result of mechanical driving of the hammer systems.

Depression data $D_{on}$ is then formulated by combining the depression intensity data $P_{on}$, the key number and the timing of on-event $t_{on}$, S106.

On the other hand, if it is determined in S102*a* that the signal change is due to release of key, a time delay period of cessation in recording $TD_{rec\text{-}off}$ which is a time lag between the timing of off-event $t_{off}$ and actual cessation of sound is determined, S107. Release data $D_{off}$ is formulated by combining the timing of off-event $t_{off}$, the key number, and depression intensity data $P_{on}$ in the same manner as in formulating depression data $D_{on}$ at step S106. The depression intensity data $P_{on}$ for the release key data $D_{off}$ is zero in general.

The depression data $D_{on}$ thus prepared is then combined with the time delay period of emission in recording $TD_{rec\text{-}on}$ to become a set of performance information $D_{on}+TD_{rec}$. On the other hand, the release data $D_{off}$ is combined with the time delay period of cessation in recording $TD_{rec\text{-}off}$ to become a set of performance information $D_{off}+TD_{rec}$. The performance information $D_{on}+TD_{rec}$ or the performance information $D_{off}+TD_{rec}$ is temporarily stored at an unoccupied channel of an assigner specifically provided for recording within the RAM 13, S108. One assigner comprises sixty-four channels.

Figure 6:
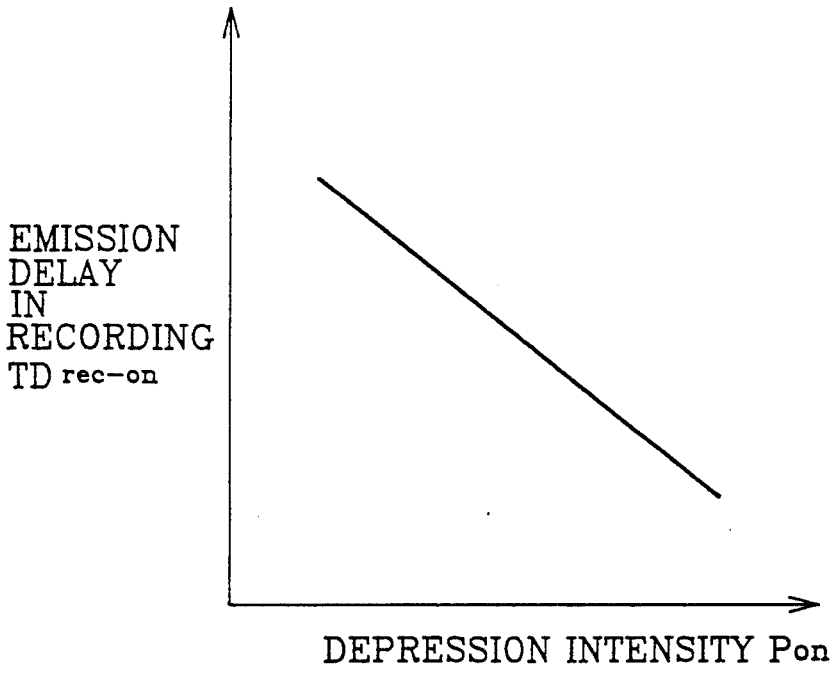
FIG. 6 is an explanatory a graph to show an example of a map which is referred to in the recording process.

Since the time delay period of emission in recording $TD_{rec\text{-}on}$ is a time lag between occurrence timing of an on-event detected in response to depression of a key by a performer and actual emission of sound, the time period becomes longer as the depression intensity $P_{on}$ diminishes, within the range of several milliseconds to 100 milliseconds as shown in FIG. 6. In preparing this embodiment, the time delay period of emission in recording $TD_{rec\text{-}on}$ is derived using the depression intensity data $P_{on}$ mapped out within the ROM 12, given the actual depression intensity $P_{on}$ calculated at S103, and assigned a specific value through interpolation or other similar method.

On the other hand, the time delay period of cessation in recording $TD_{rec\text{-}off}$ in this embodiment is preset at 35 milliseconds, which is a representative value of traveling speed of the keys 3 in response to release of a key. The traveling speed varies according to the mechanical characteristics of the keys 3 and other moving members.

In a highly skilled performance, keys 3 may be slowly released intentionally. In order to reproduce the performance, so called "off-velocity" is calculated in the same manner as at S102–S105 according to the time lag between the detected values of the key sensors 7 and 8 in changing from "off" to "on". The relation between the off-velocity and cessation delay in recording $TD_{rec\text{-}off}$ may be mapped out such that the time delay period of the cessation in recording $TD_{rec\text{-}off}$ lengthens as the off-velocity decreases. The time delay period of cessation in recording $TD_{rec\text{-}off}$ can be calculated according to this mapped out relation between the off-velocity and the cessation delay in recording.

As a result of step S108, RAM 13 stores, by hexadecimal notation, the delay in recording data $TD_{rec}$ at a first byte, the key number data $K_{No.}$ at a second byte, and the depression intensity data $P_{on}$ at a third byte as shown in FIG. 7. Although the figure shows only the depression data $D_{on}$, the release data $D_{off}$ is stored in the same manner.

Figure 5A:
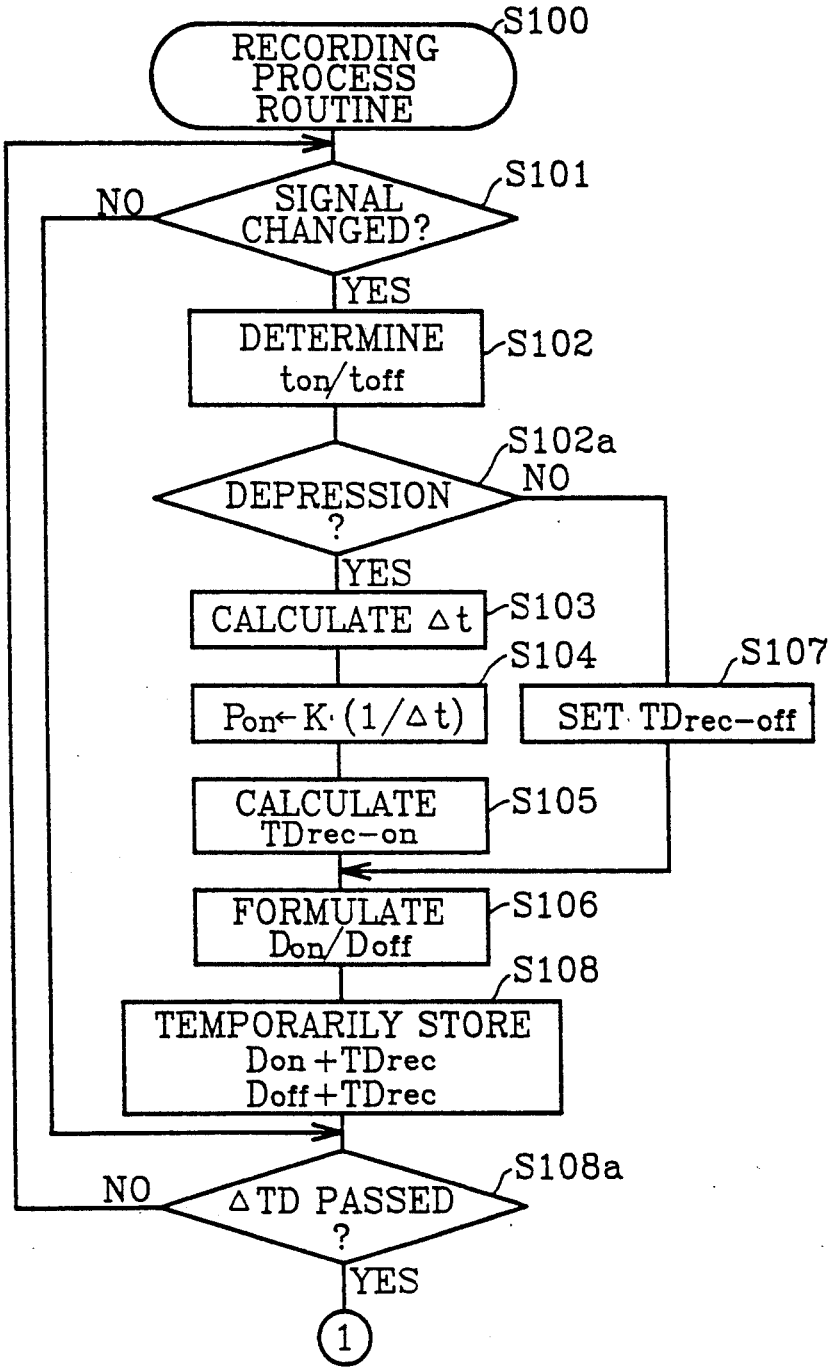
FIGS. 5A and 5B together are a flowchart illustrating the recording process of one embodiment of the present invention.
Figure 5B:
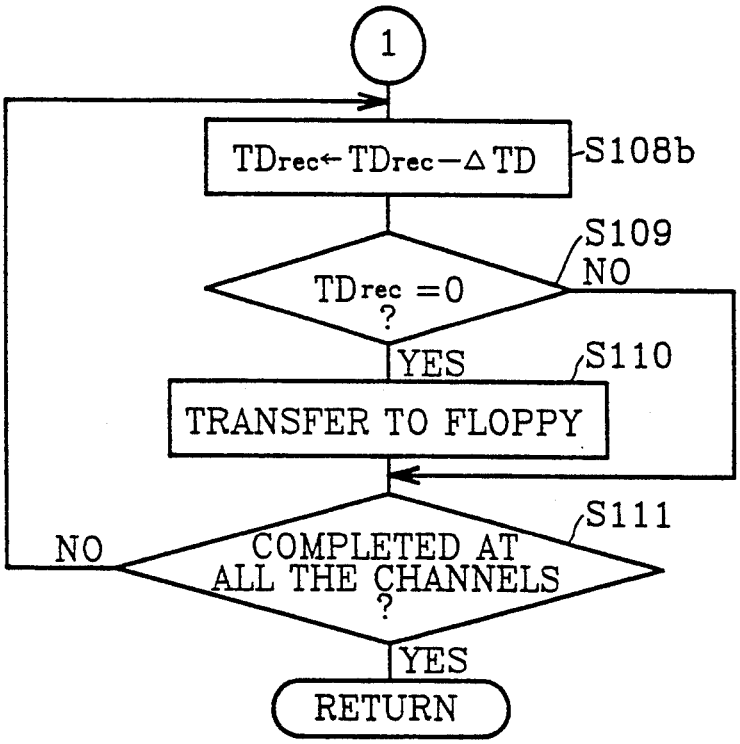

Subsequently, the present method examines whether a certain short time period ΔTD (5 milliseconds in this embodiment) has passed, S108*a*, FIG. 5A. If not, the process step returns to S101. If it is judged to be "NO" at S101, the process proceeds directly to S108*a*, skipping S102–S108.

If it is judged to be "YES" at S108*a*, the short time period ΔTD is subtracted from the time period of delay in recording data $TD_{rec}$ temporarily stored at the channel which is to be processed first among the other channels within the assigner for recording, S108*b*. It is then examined whether the time period of delay in recording data $TD_{rec}$ has become 0 milliseconds (S109). If so, the information is stored as performance information on floppy disc 21, S110. Subsequently, it is examined whether the process steps at S108 and S109 are completed for all the channels (S111). If there is any channel which has not completed the process steps, the predetermined value ΔTD is subtracted from the time period of delay in recording data $TD_{rec}$ of the channel, S108b, and the process steps at S109 and thereafter are repeated. If it is judged to be "NO" at S109, the process step proceeds on to step S111, skipping step S110.

According to the recording method thus conducted, the balance between emission timing and cessation timing of actual performance can be maintained in recording. Specifically, occurrence timing of on-event $t_{on}$ and occurrence timing of off-event $t_{off}$ are not only obtained from mechanical operation, but are corrected to result in performance information reflecting actual emission timing and cessation timing.

The reproducing method adopted in another embodiment of the present invention will now be explained hereunder.

Figure 8A:
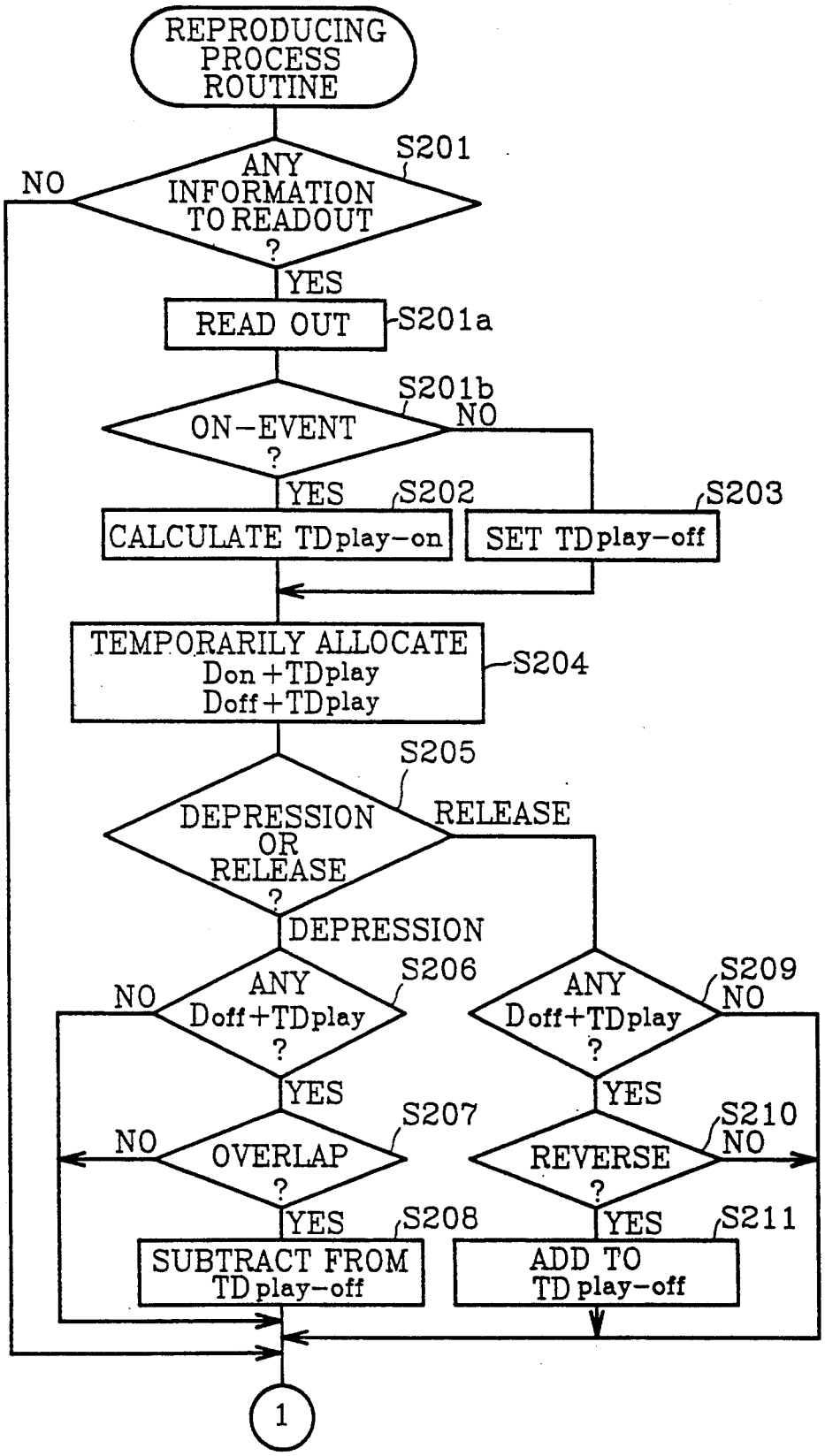
FIGS. 8A and 8B together are a flowchart showing the embodied reproduction process steps.
Figure 8B:
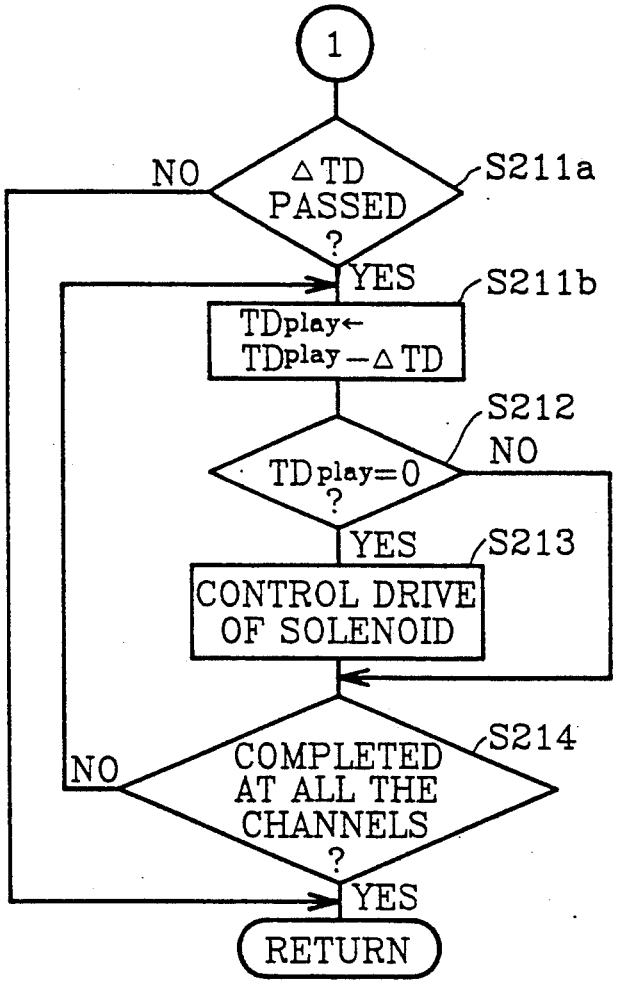

The process steps are started by selecting a reproduction mode on the operation panel 27 and proceeds as shown in FIGS. 8A and 8B.

It is first examined whether there is any information to be read out from the floppy disc 21. Specifically, by judging from the information concerning the time series of depression data $D_{on}$ and release data $D_{off}$, whether it is time to read out either of the depression data $D_{on}$ and the release data $D_{off}$ is determined, S201. Since an event method is adopted also in this reproduction processes, the characteristics of depression data $D_{on}$ and release data $D_{off}$ are independent from each other.

The data to be read out, if any, is read out from the floppy disc 21, S201*a*, and whether the data was caused by an on-event is determined, S201*b*. If the data was caused by on-event, i.e. the data is depression data $D_{on}$, a time delay period of sound emission in reproduction $TD_{play\text{-}on}$ is calculated according to the depression intensity data $P_{on}$, S202. On the other hand, if the data read out from the floppy disc 21 is release data $D_{off}$, a time period of cessation in reproduction $TD_{play\text{-}off}$ is set, S203. Then the calculated time delay period of sound emission in reproduction $TD_{play\text{-}on}$ and the set time delay period of cessation in reproduction $TD_{play\text{-}off}$ are added to the depression data $D_{on}$ and the release data $D_{off}$ to formulate performance information data $D_{on}+TD_{play}$ and $D_{off}+TD_{play}$, respectively. The performance information data $D_{on}+TD_{play}$ or $D_{off}+TD_{play}$ is temporarily allocated at an unoccupied channel of an assigner for reproduction within the RAM 13, S204. The assigner for the reproduction mode also comprises sixty-four channels.

Figure 9:
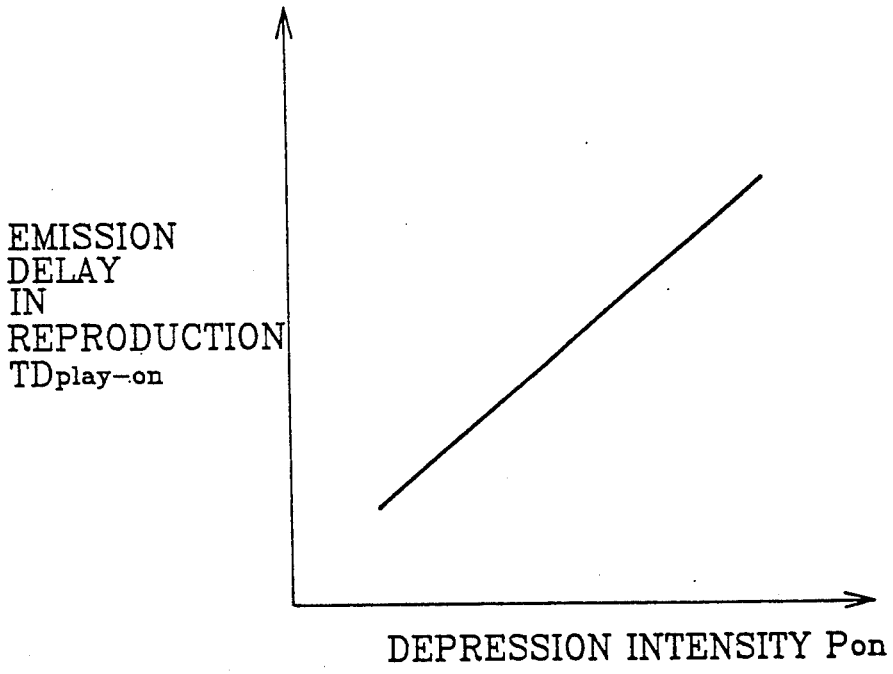
FIG. 9 is an explanatory graph to show an example of a map which is referred to in the reproduction process steps.
Figure 12:
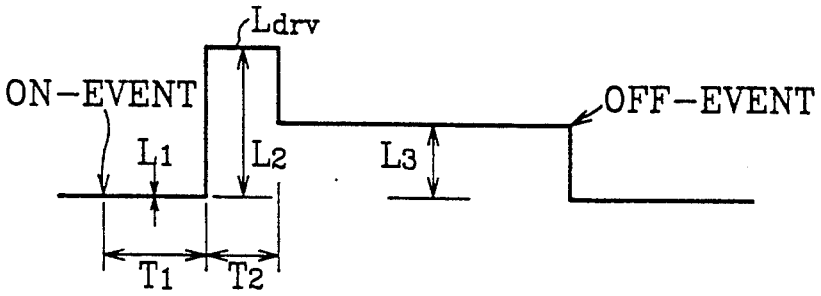
FIG. 12 is a time chart to show the line of driving power adopted in the prior art reproduction method.

As shown in FIG. 9, as depression intensity $P_{on}$ increases, the time delay period of the emission in reproduction $TD_{play\text{-}on}$ lengthens within the range from several milliseconds to 100 milliseconds. Therefore, the time delay period of emission in reproduction $TD_{play\text{-}on}$ is also derived using the depression intensity data $P_{on}$, mapped out within ROM 12, given the actual depression intensity $P_{on}$, and assigned a specific value through interpolation or other similar method. On the other hand, the time delay period of cessation in reproduction $TD_{play\text{-}off}$ is set at 35 milliseconds, which is a representative value of the traveling speed of the keys 3. The traveling speed of the keys 3 depends on the mechanical characteristics of the keys 3 and other moving members. Therefore, the value of the time delay period of cessation in reproduction $TD_{play\text{-}off}$ may be varied by incorporating the calculated off-velocity of the keys.

Figure 13:
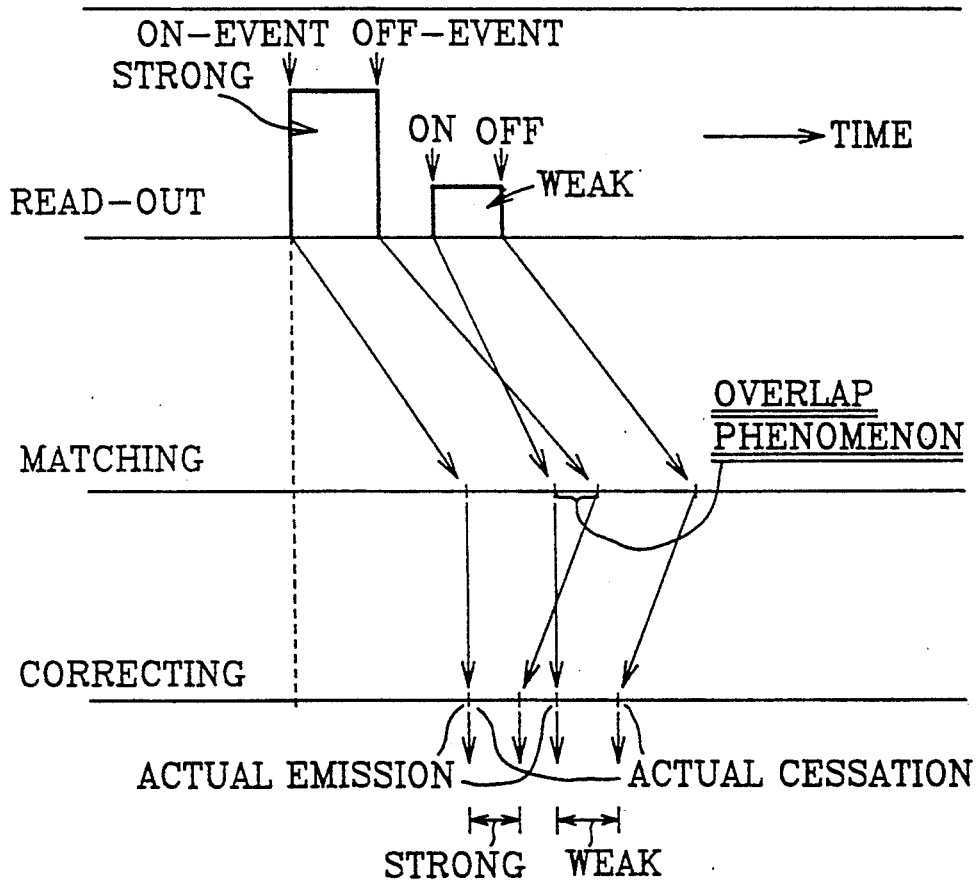
FIG. 13 is a timing diagram illustrating the elimination of overlap phenomenon according to the present invention.

Subsequently, it is examined whether the allocated performance information data was caused in response to a depressed-key or to a released-key, S205. If it is determined that the data was caused in response to a depressed-key, and if performance information data $D_{off}+TD_{play}$ concerning released-key on the same key has already been allocated within the assigner for playing, S206, it is examined whether the time delay period of cessation in reproduction $TD_{play\text{-}off}$ included in the performance information data $D_{off}+TD_{play}$ already allocated is longer than the time delay period of emission in reproduction $TD_{play\text{-}on}$ included in the performance information data $D_{on}+TD_{play}$ which is to be newly allocated, S207. It is thus judged whether an "overlap phenomenon" will be caused by the new allocation. If it is determined to be "YES" at S207, a mandatory subtraction is performed on the time delay period of cessation in reproduction $TD_{play\text{-}off}$ included in the already allocated performance information data $D_{off}+TD_{play}$ concerning released-key such that the time delay period of cessation in reproduction $TD_{play\text{-}off}$ becomes shorter than the time delay period of emission in reproduction $TD_{play\text{-}on}$ included in the performance information data $D_{on}+TD_{play}$ to be newly allocated, S208. Thus, the cessation in reproduction is corrected to occur before the emission of sound caused by the subsequent key stroke, FIG. 13.

Figure 14:
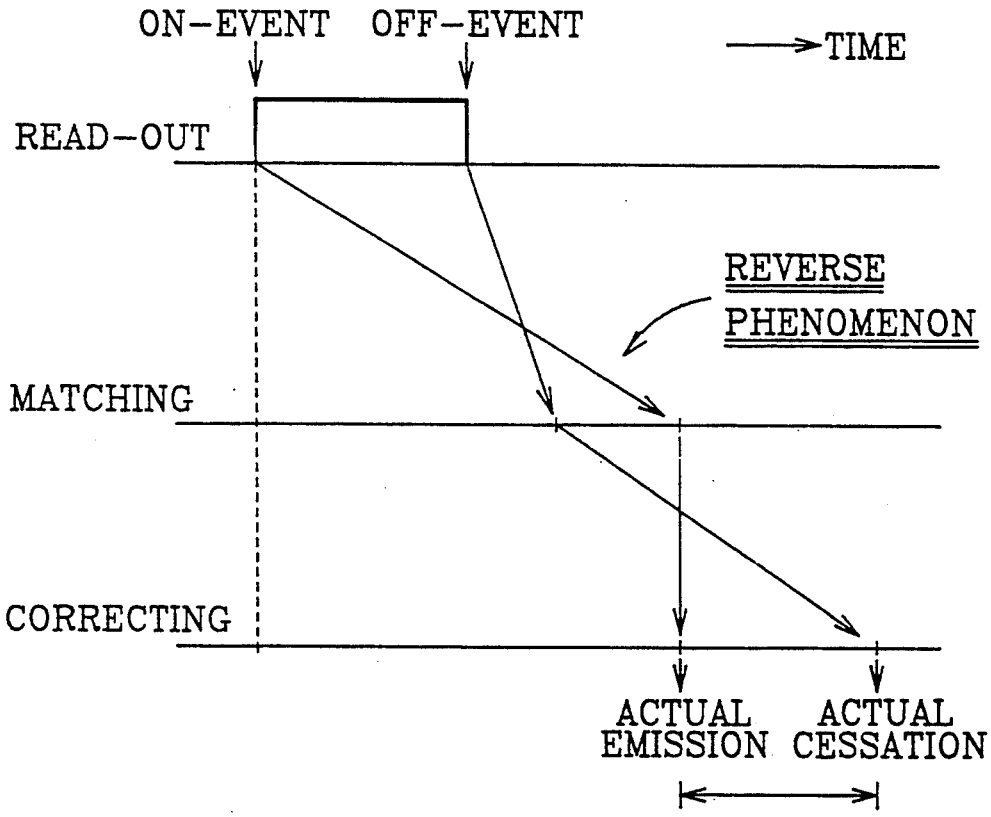
FIG. 14 is a timing diagram illustrating the elimination of reverse phenomenon according to the present invention.

On the other hand, if it is determined at S205 that the allocated performance information data was caused in response to the release of a key, and that performance information data $D_{on}+TD_{play}$ concerning depression on the same key has already been allocated within the assigner for reproduction, S209, it is next examined whether the time period of emission delay in reproduction $TD_{play\text{-}on}$ included in the performance information data $D_{on}+TD_{play}$ already allocated is longer than the time delay period of cessation in reproduction $TD_{play\text{-}off}$ included in the performance information data $D_{off}+TD_{play}$ which is to be newly allocated, S210. It is thus judged whether a "reverse phenomenon" will be caused by the new allocation, FIG. 14. If it is determined to be "YES" at S210, a mandatory addition is performed on the time delay period of cessation in reproduction $TD_{play\text{-}off}$ included in the performance information data $D_{off}+TD_{play}$ concerning release of a key such that the time delay period of cessation in reproduction $TD_{play\text{-}off}$ becomes longer than the time delay period of emission in reproduction $TD_{play\text{-}on}$ included in the performance information data $D_{on}+TD_{play}$ already allocated, S211. Thus, the time delay period of sound cessation is again adjusted to occur after sound emission to correct the reverse phenomenon, FIG. 14.

As a result of process steps at S206–S208, the information stored in the assigner for reproduction within the RAM 13 is rewritten from the state shown in FIG. 10A to the state shown in FIG. 10B. A first byte of the assigner stores the delay in reproduction data $TD_{play}$, a second byte stores key number data as $K_{No}$, and a third byte stores depression intensity data $P_{on}$ by hexadecimal notation. Similarly, as a result of process steps at S209–S211, the information stored within the RAM 13 is rewritten from the state shown in FIG. 11A to the state shown in FIG. 11B.

Subsequently, it is examined if a certain short time period ΔTD (5 milliseconds in this embodiment) has passed, S211*a*, FIG. 8B. If it is determined to be "NO", the process steps is end. When it is determined to be "NO" either at S201, S206, S207, S209 and S210, the process steps proceed directly to this step S211*a*, skipping process steps thereafter.

If it is judged to be "YES" at step S211*a*, the short time period ΔTD is subtracted from the time period of delay in reproduction data $TD_{play}$ temporarily allocated at the channel which is to be processed first among the other channels within the assigner for reproduction, S211*b*. Then it is examined if there is any delay in reproduction data $TD_{play}$ which has become 0 millisecond in time period by the subtraction, S212.

If it is determined to be "YES" at S212, the key drive solenoid 25 is immediately driven to a predetermined voltage level determined by the depression data $D_{on}$ or terminated according to the release data $D_{off}$ combined with delay in reproduction data $TD_{play}$ which has become 0 millisecond, S213. Subsequently, it is examined whether the process steps at S211*b* and thereafter are completed at all the channels of the assigner for reproduction, S214. If there is any channel which has not completed the process steps, the short time period ΔTD is subtracted from the delay in reproduction data $TD_{play}$ of the performance information temporarily allocated at the channel. S211*b*, and the process steps at S212 and thereafter are repeated. If it is determined to be "NO" at step S212, the process steps proceeds to S214, skipping step S213.

Thus, the key drive solenoid 25 is driven or the drive voltage terminated, favorably reflecting the actual timing of emission and cessation, in direct response to the performance information. Specifically, since occurrence timing of on-event $t_{on}$ is output according to actual emission timing, the solenoid drive circuit need not conduct a logical operation to calculate a sound prohibited time period. Therefore, the solenoid can be immediately driven in response to an on-event.

With the processes at S205–S211 adopted for adjusting cessation timing to emission timing, the method and device according to this invention successfully prevents occurrence of "overlap phenomenon" due to consecutive strokes on one same key, and "reverse phenomenon" by performing of hora staccato notes.

In preventing "overlap phenomenon" and "reverse phenomenon", the method and device according to this invention corrects cessation timing, but not emission timing, thereby achieving the object without causing imbalance of emission timing. Since the balance in a performance as a whole depends greatly on the emission timing, the mandatory changing of cessation timing does no harm on the whole balance of the performance.

This invention has been described above with reference to a preferred embodiment as shown in the drawings. Modifications and alterations may become apparent to one skilled in the art upon reading and understanding the specification. Despite the use of the embodiment for illustration purposes, it is intended to include all such modifications and alterations within the scope and the spirit of the appended claims.

Wherefore, having described the present invention, what is claimed is:

1. A method for controlling sound emission during reproduction of a performance in an automatic performing piano, wherein said piano records and reproduces performance information comprising key depression data and key release data, said key depression data comprising key number and depression intensity, said key release data comprising key number, said piano including a plurality of piano key drive solenoids responsive to applied electric power having a first value determined according to said depression intensity included in said depression data, said electric power applied at a second value terminating the actuation of said plurality of piano key drive solenoids in response to said release data, and whereby said piano automatically reproduces a performance according to said performance information, said method comprising the steps of:

matching emission timings of strong key strokes and weak key strokes by delaying said performance information according to a calculated time lag between the time to start said actuation of said key drive solenoids and emission of sound in reproduction, said time lag determined according to said depression intensity; and correcting said matched emission timing if, after said matching, the order of emission timing obtained from said key depression data and cessation timing obtained from said key release data is reversed to the order of depression and release key data stored as performance information.

2. The method of claim 1, wherein said method comprises the step of determining said time lag such that the larger the said depression intensity is, the smaller said time lag.

3. The method of claim 1, wherein said step of matching and correcting further include the steps of:

determining if a given performance information is key depression data or key release data;

if said given performance information is key depression data, performing the steps of:

determining that key release data for the different key stroke on the same piano key is immediately preceding the given performance information key depression data;

determining that cessation timing obtained from said key release data occurs after emission timing obtained from said key depression data; and changing said cessation timing such that said cessation timing occurs before said emission timing.

4. The method of claim 1, wherein said step of matching and correcting further include the steps of:

determining if a given performance information is key depression data or key release data;

if said given performance information is key release data, performing the steps of:

determining that counterpart key depression data for the same piano key stroke is immediately preceding the given key release data;

determining emission timing obtained form said key depression data occurs after cessation timing obtained from said key release data; and changing said cessation timing such that said cessation timing occurs after said emission timing.

5. A device for controlling sound emission in an automatic performing piano having a plurality of keys comprising:

performance information memory means, for storing key depression data and key release data in sequence as performance information, said key depression data comprising key number and depression intensity, said key release data comprising key number;

performance information readout means, for reading out in said sequence said key depression data and key release data included in said performance information; and a plurality of solenoid drive means, one solenoid drive means coupled to each of said piano keys, and responsive to an electric current having a value determined according to said depression intensity included in said key depression data, said device further comprising:

matching means, for matching emission timing of strong key strokes and weak key strokes by delaying performance information read-out by said performance information readout means according to the time lag between the time to start actuation of key drive solenoids and emission of sound in reproduction; and cessation timing changeover means, for changing cessation timing to occur after a counterpart emission timing for the same key stroke if the order of said emission timing and said cessation timing for the same key stroke is reversed by said matching means.

6. The device of claim 5 wherein said time lags increases as said key depression intensity is larger.

7. A device for controlling sound emission in an automatic performing piano having a plurality of keys comprising:

performance information memory means, for storing key depression data and key release data in sequence as performance information, said key depression data comprising key number and depression intensity, said key release data comprising key number;

performance information readout means, for reading out in said sequence said key depression data and key release data included in said performance information; and a plurality of solenoid drive means, one solenoid drive means coupled to each of said piano keys, and responsive to an electric current having a value determined according to said depression intensity included in said key depression data, said device further comprising:

matching means, for matching emission timing of strong key strokes and weak key strokes by delaying performance information read-out by said performance information readout means according to the time lag between the time to start actuation of key drive solenoids and emission of sound in reproduction; and cessation timing changeover means, for changing cessation timing to occur before emission timing of the different key stroke on the same piano key if the order of said emission timing precedes said cessation timing by said matching means.

* * * * *